US006084548A

United States Patent [19]

Hirabe

[11] Patent Number: 6,084,548

[45] Date of Patent: Jul. 4, 2000

[54] MICRO-STRIP ANTENNA

[76] Inventor: Masashi Hirabe, c/o NEC Corporation, 7-1, Shiba 5-chome, Minato-ku Tokyo, Japan

[21] Appl. No.: 09/211,894

[22] Filed: Dec. 15, 1998

[30] Foreign Application Priority Data

Dec. 15, 1997 [JP] Japan ..... 9-363523

[51] Int. Cl.[7] ..... H01Q 1/38

[52] U.S. Cl. ..... 343/700 MS; 343/767

[58] Field of Search ..... 343/700 MS, 767; H01Q 1/38

[56] References Cited

U.S. PATENT DOCUMENTS

| | | | |
|---|---|---|---|
| 4,899,164 | 2/1990 | McGrath | 343/700 MS |
| 5,510,803 | 4/1996 | Ishizaka et al. | 343/700 MS |

FOREIGN PATENT DOCUMENTS

| | | |
|---|---|---|
| 52-134350 | of 1977 | Japan . |
| 5-129825 | of 1993 | Japan . |
| 6-120729 | 4/1994 | Japan . |
| 7-240621 | of 1995 | Japan . |
| 7-240622 | of 1995 | Japan . |
| 7-46028 | 2/1995 | Japan . |
| 8-172313 | of 1996 | Japan . |

OTHER PUBLICATIONS

Office Action Issued by the Japanese Patent Office on Apr. 6, 1999 for the Corresponding Japanese Application and an English Translation Thereof.

*Primary Examiner*—Don Wong
*Assistant Examiner*—Hoang Nguyen
*Attorney, Agent, or Firm*—Ostrolenk, Faber, Gerb & Soffen, LLP

[57] ABSTRACT

There is provided an antenna including (a) a first micro-strip antenna, (b) a second micro-strip antenna spaced away from and facing the first micro-strip antenna, (c) a ground plate located between the first and second micro-strip antennas, the ground plate being formed with an opening overlapping both the first and second micro-strip antennas, (d) a first dielectric material sandwiched between the first micro-strip antenna and the ground plate, (e) a second dielectric material sandwiched between the second micro-strip antenna and the ground plate, and (f) a micro-strip line formed on a surface of the first dielectric material and connected to the first micro-strip antenna. In accordance with the antenna, when electromagnetic wave is supplied to the first micro-strip antenna, the first micro-strip antenna resonates and radiates electromagnetic waves to atmosphere therearound. The second micro-strip antenna is electromagnetically coupled to the first micro-strip antenna through the opening formed at the ground plate. As a result, the second micro-strip antenna resonates to the first micro-strip antenna to thereby radiate electromagnetic waves to atmosphere similarly to the first micro-strip antenna. Hence, the antenna is able to have bi-directional or non-directional characteristic. In addition, since electric power is supplied only to the first micro-strip antenna, it is no longer necessary for the antenna to include a three-dimensional power distributor unlike a conventional antenna, ensuring that the antenna can be fabricated in a smaller size.

30 Claims, 6 Drawing Sheets

MICRO-STRIP ANTENNA

BACKGROUND OF THE INVENTION

1. Field of the Invention

The invention relates to an antenna comprised of micro-strip antennas and having bi-directional or non-directional characteristic.

2. Description of the Related Art

FIG. 1 is a perspective view illustrating a conventional antenna comprised of micro-strip antennas and having bi-directional or non-directional characteristic.

As illustrated in FIG. 1, the conventional antenna 102 is comprised of a first micro-strip antenna 104, a second micro-strip antenna 106 spaced away from and facing the first micro-strip antenna 104, a ground plate 108 located between the first and second micro-strip antennas 104 and 106, a first dielectric plate 110*a* composed of insulating material and sandwiched between the first micro-strip antenna 104 and the ground plate 108, a second dielectric plate 110*b* composed of insulating material and sandwiched between the second micro-strip antenna 106 and the ground plate 108, and an electric power distributor 112 for feeding electric power to the first and second micro-strip antennas 104 and 106.

A first micro-strip line 114 is formed on a surface of the first dielectric plate 110*a* and is connected to the first micro-strip antenna 104, and a second micro-strip line 116 is formed on a surface of the second dielectric plate 110*b* and is connected to the second micro-strip antenna 106. Electric power supplied to a feeding terminal 118 is distributed by the electric power distributor 112 to the first and second micro-strip antennas 104 and 106 through the first and second micro-strip lines 114 and 116, respectively.

However, the antenna 102 is accompanied with a problem that since the first and second micro-strip antennas 104 and 106 are positioned at opposite sides of the ground plate 108, the electric power distributor 112 for feeding electric power to the first and second micro-strip antennas 104 and 106 has to be three-dimensional. Specifically, the electric power distributor 112 has to have a width equal to or greater than a total width of the first and second dielectric plates 110*a* and 110*b*. As a result, the antenna 102 cannot avoid being larger in size due to the three-dimensional distributor 112.

Japanese Unexamined Patent Publication No. 6-120729 having been published on Apr. 28, 1994 has suggested an antenna comprised of a first dielectric plate, a second dielectric plate adhered to the first dielectric plate, a first planar electrical conductor formed on a surface of the first dielectric plate, and a second planar electrical conductor formed on a surface of the second dielectric plate.

The antenna suggested in the above-mentioned Publication is accompanied with the same problem as that of the antenna illustrated in FIG. 1. Namely, since the first and second planar electrical conductors are positioned at opposite sides of the dielectric plates, an electric power distributor for feeding electric power to the first and second planar electrical conductors has to be three-dimensional, due to which the antenna cannot avoid to be larger in size.

Japanese Unexamined Patent Publication No. 7-46028 having been published on Feb. 14, 1995 has suggested an antenna comprised of a dielectric plate, and radiation slots formed on opposite surfaces of the dielectric plate.

Since the radiation slots are formed at opposite surfaces of the dielectric plate, the antenna suggested in the above-identified Publication is accompanied with a problem that an electric power distributor for feeding electric power to the radiation slots has to be three-dimensional, due to which the antenna cannot avoid to be larger in size.

SUMMARY OF THE INVENTION

In view of the above-mentioned problem, it is an object of the present invention to provide an antenna which is capable of operating without a three-dimensional electric power distributor, and hence, making it possible to fabricate an antenna equipment including the antenna, in a smaller width.

There is provided an antenna including (a) a first micro-strip antenna, (b) a second micro-strip antenna spaced away from and facing the first micro-strip antenna, (c) a ground plate located between the first and second micro-strip antennas, the ground plate being formed with an opening overlapping both the first and second micro-strip antennas, (d) a first dielectric material sandwiched between the first micro-strip antenna and the ground plate, and (e) a second dielectric material sandwiched between the second micro-strip antenna and the ground plate.

The antenna may further include (f) a micro-strip line formed on a surface of the first dielectric material and connected to the first micro-strip antenna.

It is preferable that the opening has an area equal to or smaller than an area of the first or second micro-strip antenna. For instance, the opening may be formed rectangular. Similarly, the first and second micro-strip antennas may be formed rectangular. When the opening is formed rectangular, it is preferable that the opening is designed to have four sides each of which is parallel to an associated side of the first and second micro-strip antennas.

It is preferable that the ground plate has a width equal to or smaller than a double width of the first or second micro-strip antenna.

There is further provided an antenna including (a) a first rectangular micro-strip antenna formed with first cut-outs at corners located on a first diagonal line thereof, (b) a second rectangular micro-strip antenna spaced away from and facing the first rectangular micro-strip antenna, and being formed with second cut-outs at corners located on a second diagonal line perpendicular to the first diagonal line, (c) a ground plate located between the first and second rectangular micro-strip antennas, the ground plate being formed with an opening overlapping both the first and second rectangular micro-strip antennas, (d) a first dielectric material sandwiched between the first rectangular micro-strip antenna and the ground plate, and (e) a second dielectric material sandwiched between the second rectangular micro-strip antenna and the ground plate.

It is preferable that the first and second cut-outs are in parallel with each other, in which case, the first and second cut-outs may make an angle of about 45 degrees relative to the micro-strip line.

There is still further provided an antenna including (a) a plurality of first micro-strip antennas arranged in a line and electrically connected to one another, (b) a plurality of second micro-strip antennas each spaced away from and facing an associated one of the first micro-strip antennas, (c) a ground plate located between the first and second micro-strip antennas, the ground plate being formed with a plurality of openings each overlapping each of the first micro-strip antennas and associated second micro-strip antennas, (d) a first dielectric material sandwiched between the first micro-strip antennas and the ground plate, and (e) a second dielectric material sandwiched between the second micro-strip antennas and the ground plate.

It is preferable that the first micro-strip antennas are electrically connected to one another through a micro-strip line formed on a surface of the first dielectric material.

It is preferable that each of the openings has an area equal to or smaller than an area of each of the first or second micro-strip antennas. For instance, each of the openings may be formed rectangular. The first and second micro-strip antennas may be formed rectangular.

When each of the openings is formed rectangular, it is preferable that each of the openings is designed to have sides each of which is parallel to an associated side of each of the first and second micro-strip antennas.

There is yet further provided an antenna including (a) a plurality of first rectangular micro-strip antennas arranged in a line and electrically connected to one another, each of the first rectangular micro-strip antennas being formed with first cut-outs at corners located on a first diagonal line thereof, (b) a plurality of second rectangular micro-strip antennas each spaced away from and facing an associated one of the first rectangular micro-strip antennas, each of the second rectangular micro-strip antennas being formed with second cut-outs at corners located on a second diagonal line perpendicular to the first diagonal line, (c) a ground plate located between the first and second rectangular micro-strip antennas, the ground plate being formed with a plurality of openings each overlapping each of the first rectangular micro-strip antennas and an associated second rectangular micro-strip antenna, (d) a first dielectric material sandwiched between the first rectangular micro-strip antennas and the ground plate, and (e) a second dielectric material sandwiched between the second rectangular micro-strip antennas and the ground plate.

In accordance with the antenna, when electromagnetic wave is supplied to the first micro-strip antenna, the first micro-strip antenna resonates and radiates electromagnetic waves to atmosphere therearound. The second micro-strip antenna is electromagnetically coupled to the first micro-strip antenna through the opening formed at the ground plate. As a result, the second micro-strip antenna resonates to the first micro-strip antenna to thereby radiate electromagnetic waves to atmosphere similarly to the first micro-strip antenna. Hence, the antenna is able to have bi-directional or non-directional characteristic.

In addition, since electric power is supplied only to the first micro-strip antenna, it is no longer necessary for the antenna to include a three-dimensional power distributor unlike a conventional antenna, ensuring that the antenna can be fabricated in a smaller size.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

[First Embodiment]

Figure 2:
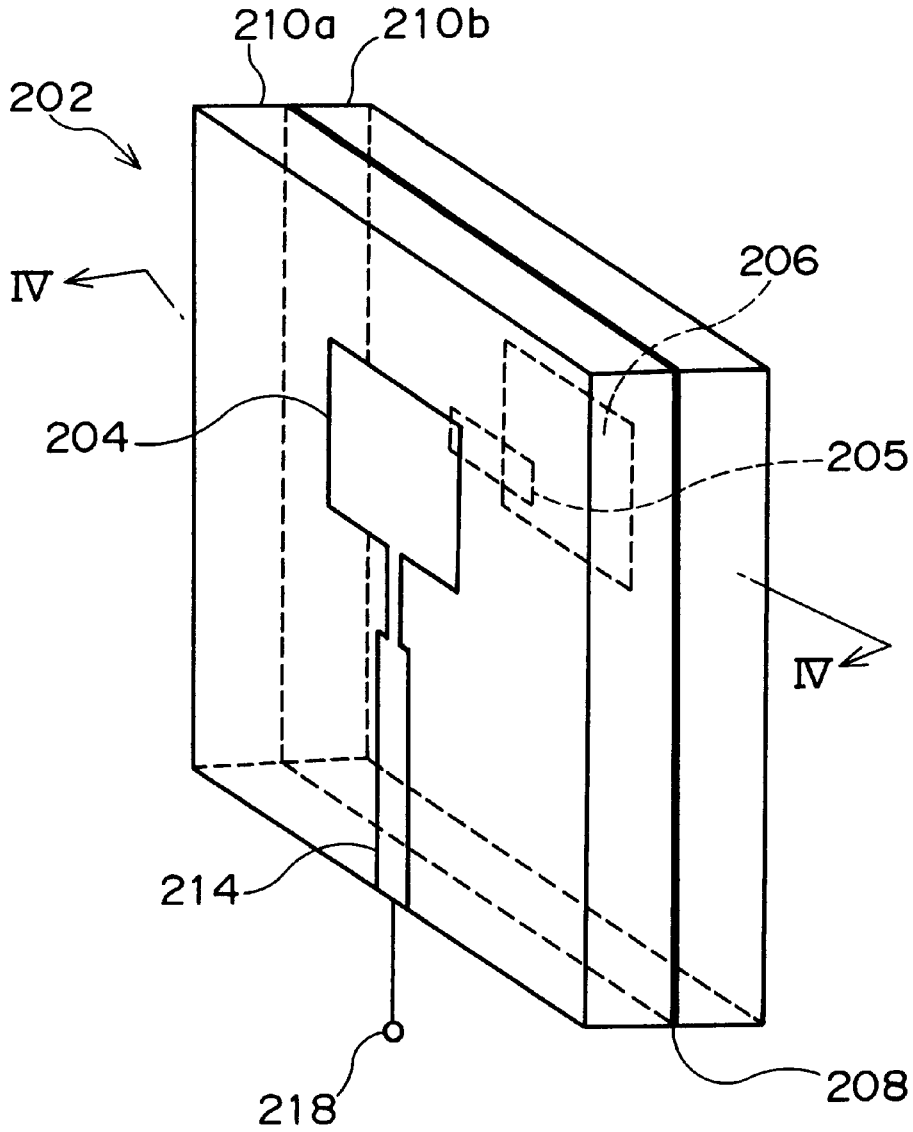
FIG. 2 is a perspective view illustrating an antenna in accordance with the first embodiment.

FIG. 2 illustrates an antenna in accordance with the first embodiment.

As illustrated in FIG. 2, an antenna 202 in accordance with the first embodiment is comprised of a first micro-strip antenna 204, a second micro-strip antenna 206 spaced away from and facing the first micro-strip antenna 204, a ground plate 208 located between the first and second micro-strip antennas 204 and 206, a first dielectric plate 210*a* composed of insulating material and sandwiched between the first micro-strip antenna 204 and the ground plate 208, and a second dielectric plate 210*b* composed of insulating material and sandwiched between the second micro-strip antenna 206 and the ground plate 208.

The first and second micro-strip antennas 204 and 206 are formed rectangular, and composed of electrical conductor in the form of a plate. The first micro-strip antenna 204 is coextensive with the second micro-strip antenna 206. The ground plate 208 is composed of electrical conductor.

The first dielectric plate 210*a* makes close contact at one of surfaces thereof with one of surfaces of the ground plate 208, and the second dielectric plate 210*b* makes close contact at one of surfaces thereof with the other surface of the ground plate 208. The first micro-strip antenna 204 is adhered to the other surface, that is, an outer surface of the first dielectric plate 210*a*, and the second micro-strip antenna 206 is adhered to the other surface, that is, an outer surface of the second dielectric plate 210*b*.

The ground plate 208 is formed with a rectangular opening 205 in an area overlapping both the first and second micro-strip antennas 204 and 206.

The opening 205 has a smaller area than an area of the first or second micro-strip antenna 204 or 206. However, it should be noted that the opening 205 may be designed to have an area equal to or greater than an area of the first or second micro-strip antenna 204 or 206.

The opening 205 has four sides each of which is parallel to an associated side of the first and second micro-strip antennas 204 or 206.

A micro-strip line 214 composed of electrical conductor is formed on a surface of the first dielectric plate 210*a*, and connects the first micro-strip antenna 204 to a feeding terminal 218 for feeding electric power to the first micro-strip antenna 204 therethrough.

Hereinbelow is explained an operation of the antenna 202 in accordance with the first embodiment.

Figure 3:
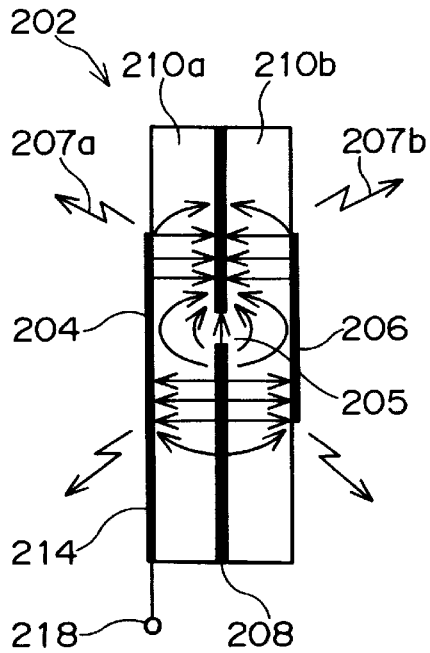
FIG. 3 is a cross-sectional view of the antenna illustrated in FIG. 2, showing an operation of the antenna.

FIG. 3 illustrates an electric field generated around the antenna 202. Electro-magnetic waves supplied to the feeding terminal 218 pass through the micro-strip line 214, and reach the first micro-strip antenna 204. As a result, the first micro-strip antenna 204 resonates and radiates electromagnetic waves 207*a* to atmosphere.

The second micro-strip antenna 206 is electromagnetically coupled to the first micro-strip antenna 204 through the opening 205 formed at the ground plate 208. As a result, the second micro-strip antenna 206 resonates to the first micro-strip antenna 204, and thus, radiates electromagnetic waves 207*b* to atmosphere, similarly to the first micro-strip antenna 204.

Thus, electromagnetic waves supplied to the feeding terminal 218 are fed to both the first and second micro-strip antennas 204 and 206, and then, radiated at opposite sides of the ground plate 208. As a result, the antenna 202 can have a bi-directional characteristic.

Figure 4:
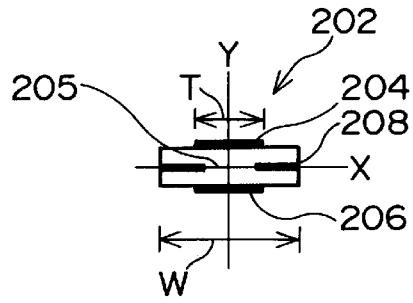
FIG. 4 is a cross-sectional view taken along the line IV—IV in FIG. 2.
Figure 5:
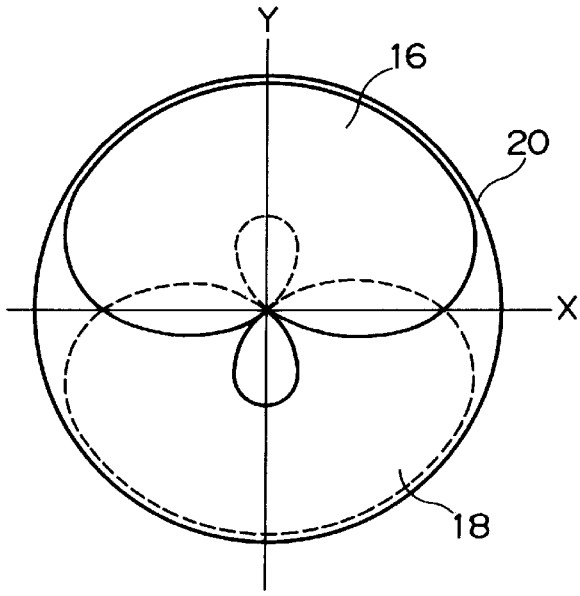
FIG. 5 is a graph showing directional characteristic of the antenna illustrated in FIG. 2.

As illustrated in FIG. 4, if the ground plate 208 is designed to have a sufficiently small width W, the first micro-strip antenna 204 would have a directional characteristic having a pattern 16 illustrated in FIG. 5 with a solid line, and the second micro-strip antenna 206 would have a directional characteristic having a pattern 18 illustrated in FIG. 5 with a broken line. Accordingly, the antenna 202 would have a directional characteristic 20 obtained by combining the patterns 16 and 18 with each other. As is obvious in view of FIG. 5, the thus obtained directional characteristic 20 is non-directional.

According to the results of the experiments the inventor conducted, it is preferable that the ground plate 208 has a width W equal to or smaller than a double width 2T of the first or second micro-strip antenna 204 or 206.

In FIG. 4, an X-axis extends in a direction in which the ground plate 208 extends, and an Y-axis extends in a direction perpendicular to the direction in which the ground plate 208 extends. In FIG. 5, an axis of abscissa corresponds to the X-axis in FIG. 4, and an axis of ordinate corresponds to the Y-axis in FIG. 4.

The antenna 202 radiates such vertically polarized, bi-directional or non-directional waves as mentioned above in X-Y plane in FIG. 4.

In the antenna 202 in accordance with the above-mentioned first embodiment, electric power is supplied only to the first micro-strip antenna 204. Hence, it is no longer necessary for the antenna 202 to include a three-dimensional electric power distributor such as the distributor 112 illustrated in FIG. 1, which ensures that an antenna equipment including the antenna 202 can be fabricated in a smaller size.

The above-mentioned antenna 202 can be employed not only as a transmitting antenna for radiating electromagnetic waves as mentioned earlier, but also as a receiving antenna, by virtue of invertibility of electromagnetic waves. When the antenna 202 is employed as a receiving antenna, it is possible to take out electromagnetic waves received only through the first micro-strip antenna 204. Hence, there can be obtained the same advantages as those obtained when the antenna 202 is employed as a transmitting antenna.

[Second Embodiment]

Figure 6:
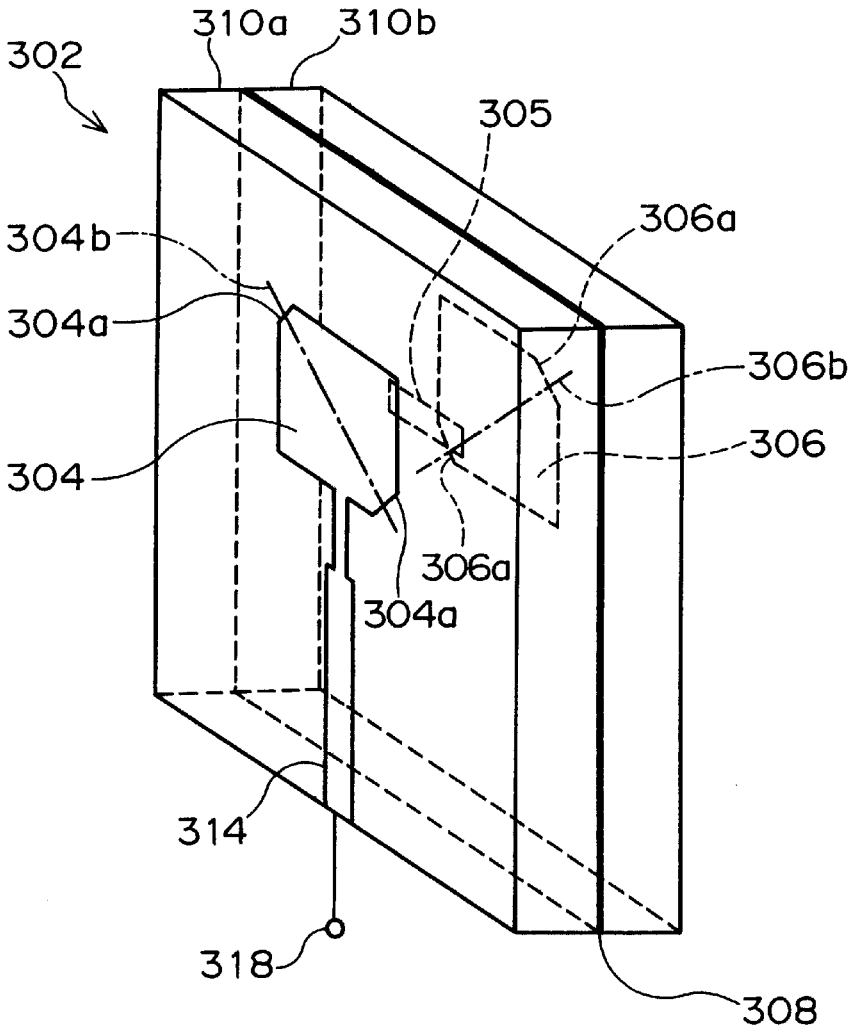
FIG. 6 is a perspective view illustrating an antenna in accordance with the second embodiment.

FIG. 6 illustrates an antenna in accordance with the second embodiment.

As illustrated in FIG. 6, an antenna 302 in accordance with the second embodiment is comprised of a first micro-strip antenna 304, a second micro-strip antenna 306 spaced away from and facing the first micro-strip antenna 304, a ground plate 308 located between the first and second micro-strip antennas 304 and 306, a first dielectric plate 310*a* composed of insulating material and sandwiched between the first micro-strip antenna 304 and the ground plate 308, and a second dielectric plate 310*b* composed of insulating material and sandwiched between the second micro-strip antenna 306 and the ground plate 308.

The first and second micro-strip antennas 304 and 306 are formed rectangular, and composed of electrical conductor in the form of a plate. The first micro-strip antenna 304 is coextensive with the second micro-strip antenna 306. The ground plate 308 is composed of electrical conductor.

In the antenna 302 in accordance with the second embodiment, the first micro-strip antenna 304 is formed with first cut-outs 304*a* at corners located on a first diagonal line 304*b* thereof. Similarly, the second micro-strip antenna 306 is formed with first cut-outs 306*a* at corners located on a second diagonal line 306*b* thereof. The second diagonal line 306*b* of the second rectangular micro-strip antenna 306 is perpendicular to the first diagonal line 304*b* of the first rectangular micro-strip antenna 304.

The first and second cut-outs 304*a* and 306*a* both make an angle of about 45 degrees relative to a direction in which the micro-strip line 10 extends.

The first and second dielectric plates 310*a* and 310*b* make close contact with the ground plate 308. The first micro-strip antenna 304 is adhered to an outer surface of the first dielectric plate 310*a*, and the second micro-strip antenna 306 is adhered to an outer surface of the second dielectric plate 310*b*.

The ground plate 308 is formed with a rectangular opening 305 in an area overlapping both the first and second micro-strip antennas 304 and 306.

The opening 305 has a smaller area than an area of the first or second micro-strip antenna 304 or 306.

The opening 305 has four sides each of which is parallel to an associated side of the first and second micro-strip antennas 304 or 306.

A micro-strip line 314 composed of electrical conductor is formed on an outer surface of the first dielectric plate 310*a*, and connects the first micro-strip antenna 304 to a feeding terminal 318 for feeding electric power to the first micro-strip antenna 304 therethrough.

Whereas the antenna 202 in accordance with the first embodiment radiates vertically polarized waves by supplying electromagnetic waves to the first micro-strip antenna 204 through the micro-strip line 214, the antenna 302 in accordance with the second embodiment radiates circularly polarized waves having bi-directional or non-directional characteristic in a plane defined by the X- and Y-axes illustrated in FIG. 4.

In the antenna 302 in accordance with the second embodiment, electric power is supplied only to the first micro-strip antenna 304. Hence, it is no longer necessary for the antenna 302 to include a three-dimensional electric power distributor such as the distributor 112 illustrated in FIG. 1, similarly to the antenna 202 in accordance with the first embodiment.

In addition, the antenna 302 can be employed not only as a transmitting antenna for radiating electromagnetic waves, but also as a receiving antenna, by virtue of invertibility of electromagnetic waves, similarly to the antenna 202 in accordance with the first embodiment.

[Third Embodiment]

Figure 7:
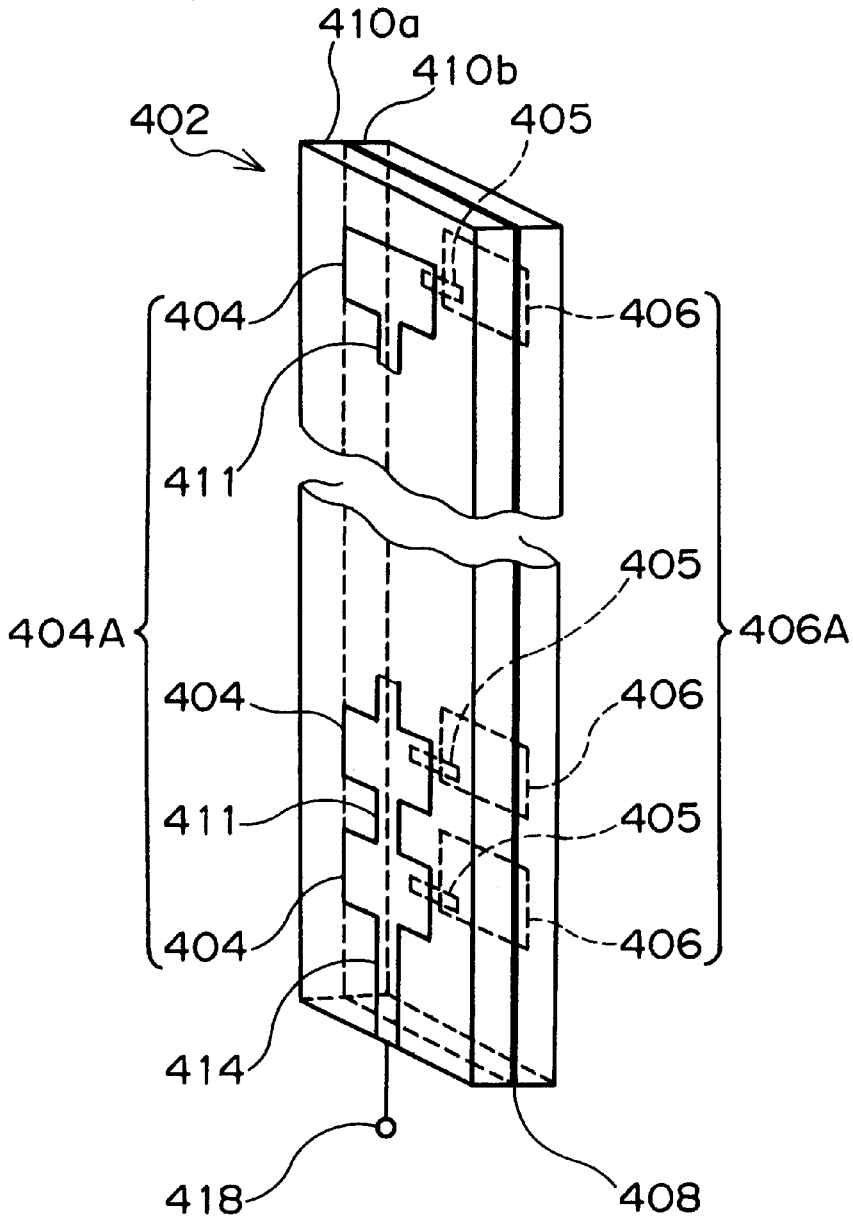
FIG. 7 is a perspective view illustrating an antenna in accordance with the third embodiment.

FIG. 7 illustrates an antenna in accordance with the third embodiment.

An antenna 402 in accordance with the third embodiment is comprised of a first antenna array 404A, a second antenna array 406A, a ground plate 408 located between the first and second antenna arrays 404A and 406A, a first dielectric plate 410*a* sandwiched between the first antenna array 404A and the ground plate 408, and a second dielectric plate 410*b* sandwiched between the second antenna array 406A and the ground plate 408.

The first antenna array 404A is comprised of a plurality of first rectangular micro-strip antennas 404 arranged in a line, a plurality of micro-strip lines 411 for connecting adjacent first micro-strip antennas 404 to each other, and a micro-strip line 414 for connecting the first micro-strip antenna 404 located at an end of the first antenna array 404A to a feeding terminal 418.

The second antenna array 406A is comprised of a plurality of second rectangular micro-strip antennas 406. Each of the second micro-strip antennas 406 is spaced away from adjacent one, and faces an associated one of the first micro-strip antennas 404.

The ground plate 408 is formed with a plurality of openings 405 in areas overlapping both the first micro-strip antennas 404 and the associated second micro-strip antennas 406. Each of the openings 405 has a smaller area than an area of each of the first or second micro-strip antennas 404 or 406. Each of the openings 405 has four sides each of which is parallel to an associated side of the first and second micro-strip antennas 404 or 406.

The antenna 402 in accordance with the third embodiment provides the same advantages as those obtained by the first embodiment.

In the antenna 402, electric power is supplied only to the first micro-strip antennas 404. Hence, it is no longer necessary for the antenna 402 to include a three-dimensional electric power distributor such as the distributor 112 illustrated in FIG. 1.

In addition, the antenna 402 can be employed not only as a transmitting antenna for radiating electromagnetic waves, but also as a receiving antenna, by virtue of invertibility of electromagnetic waves.

[Fourth Embodiment]

Figure 8:
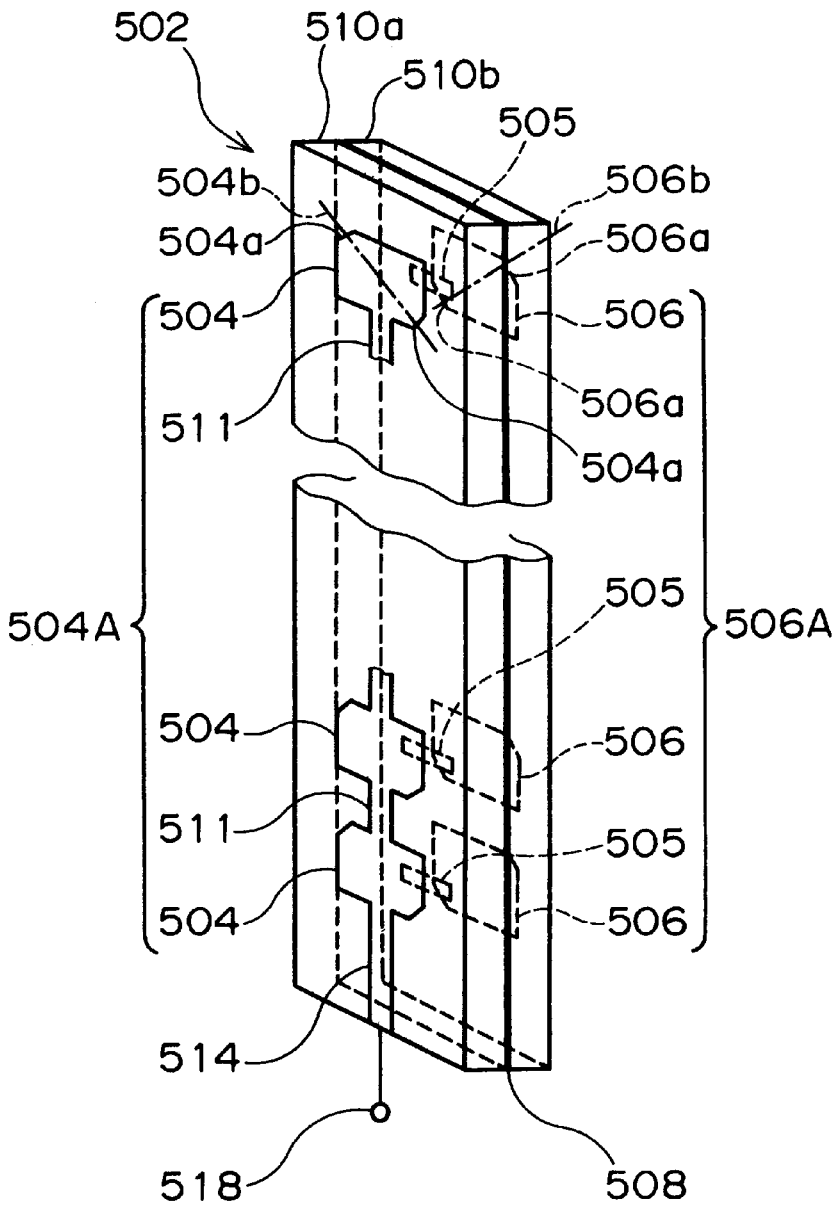
FIG. 8 is a perspective view illustrating an antenna in accordance with the fourth embodiment.

FIG. 8 illustrates an antenna in accordance with the fourth embodiment.

An antenna 502 in accordance with the fourth embodiment is comprised of a first antenna array 504A, a second antenna array 506A, a ground plate 508 located between the first and second antenna arrays 504A and 506A, a first dielectric plate 510*a* sandwiched between the first antenna array 504A and the ground plate 508, and a second dielectric plate 510*b* sandwiched between the second antenna array 506A and the ground plate 508.

The first antenna array 504A is comprised of a plurality of first rectangular micro-strip antennas 504 arranged in a line, a plurality of micro-strip lines 511 for connecting adjacent first micro-strip antennas 504 to each other, and a micro-strip line 514 for connecting the first micro-strip antenna 504 located at an end of the first antenna array 504A to a feeding terminal 518.

The second antenna array 506A is comprised of a plurality of second micro-strip antennas 506. Each of the second micro-strip antennas 506 is spaced away from adjacent one, and faces an associated one of the first micro-strip antennas 504.

Each of the first micro-strip antennas 504 is formed with first cut-outs 504*a* at corners located on a first diagonal line 504*b* thereof. Similarly, each of the second micro-strip antennas 506 is formed with first cut-outs 506*a* at corners located on a second diagonal line 506*b* thereof. The second diagonal line 506*b* of the second rectangular micro-strip antenna 506 is perpendicular to the first diagonal line 504*b* of the first rectangular micro-strip antenna 504.

The first and second cut-outs 504*a* and 506*a* both make an angle of about 45 degrees relative to a direction in which the micro-strip lines 511 extend.

The ground plate 508 is formed with a plurality of openings 505 in areas overlapping both the first micro-strip antennas 504 and the associated second micro-strip antennas 506. Each of the openings 505 has a smaller area than an area of each of the first or second micro-strip antennas 504 or 506. Each of the openings 505 has four sides each of which is parallel to an associated side of the first and second micro-strip antennas 504 or 506.

The antenna 502 in accordance with the third embodiment provides the same advantages as those obtained by the first embodiment.

Figure 1:
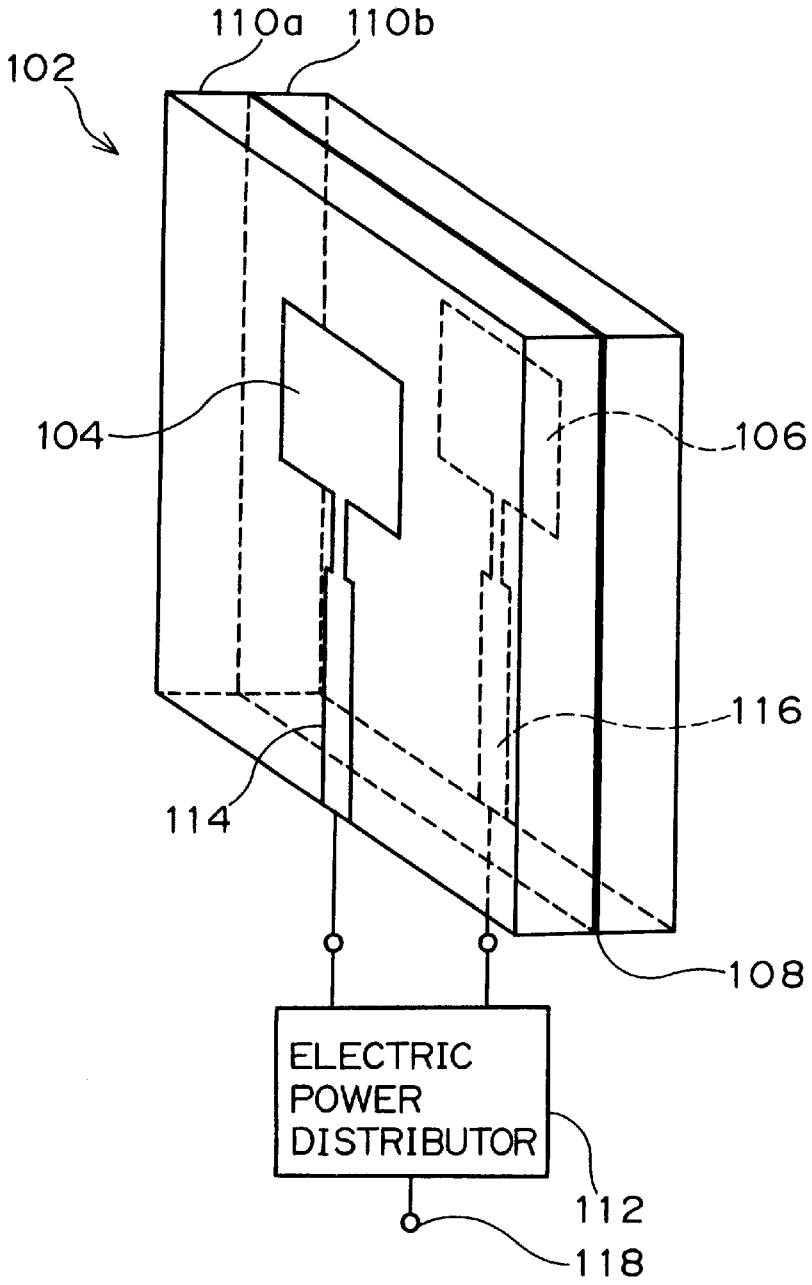
FIG. 1 PRIOR ART
FIG. 1 is a perspective view illustrating a conventional antenna.

In the antenna 502, since electric power is supplied only to the first micro-strip antennas 504, it is no longer necessary for the antenna 502 to include a three-dimensional electric power distributor such as the distributor 112 illustrated in FIG. 1.

In addition, the antenna 502 can be employed not only as a transmitting antenna for radiating electromagnetic waves, but also as a receiving antenna, by virtue of invertibility of electromagnetic waves.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 9-363523 filed on Dec. 15, 1997 including specification, claims, drawings and summary is incorporated herein by reference in its entirety.

What is claimed is:

1. An antenna comprising:

(a) a first micro-strip antenna to which electric power is supplied:

(b) a second micro-strip antenna spaced away from the facing said first micro-strip antenna, no electric power being supplied to said second micro-strip antenna:

(c) a ground plate located between said first and second micro-strip antennas, said ground plate being formed with an opening overlapping both said first and second micro-strip antennas;

(d) a first dielectric material sandwiched between said first micro-strip antenna and said ground plate; and (e) a second dielectric material sandwiched between said second micro-strip antenna and said ground plate.

2. The antenna as set forth in claim 1, further comprising (f) a micro-strip line formed on a surface of said first dielectric material and connected to said first micro-strip antenna.

3. The antenna as set forth in claim 1, wherein said opening has an area equal to or smaller than an area of said first or second micro-strip antenna.

4. The antenna as set forth in claim 1, wherein said opening is rectangular.

5. The antenna as set forth in claim 1, wherein said first and second micro-strip antennas are rectangular.

6. The antenna as set forth in claim 5, wherein said opening is rectangular, and has sides parallel to sides of said first and second micro-strip antennas.

7. The antenna as set forth in claim 1, wherein said ground plate has a width equal to or smaller than a double width of said first or second micro-strip antenna.

8. An antenna comprising:

(a) a first rectangular micro-strip antenna formed with first cut outs at corners located on a first diagonal line thereof, electric power being supplied to said first rectangular micro-strip antenna;

(b) a second rectangular micro-strip antenna spaced away from and facing said first rectangular micro-strip antenna, and being formed with second cut-outs at comers located on a second diagonal line perpendicular to said first diagonal line, no electric power being supplied to said second rectangular micro-strip antenna;

(c) a ground plate located between said first and second rectangular micro-strip antennas, said ground plate being formed with an opening overlapping both said first and second rectangular micro-strip antennas;

(d) a first dielectric material sandwiched between said first rectangular micro-strip antenna and said ground plate; and (e) a second dielectric material sandwiched between said second rectangular micro-strip antenna and said ground plate.

9. The antenna as set forth in claim 8, further comprising (f) a micro-strip line formed on a surface of said first dielectric material and connected to said first rectangular micro-strip antenna.

10. The antenna as set forth in claim 9, wherein said first and second cutouts make an angle of about 45 degrees relative to said micro-strip line.

11. The antenna as set forth in claim 8, wherein said first and second cutouts are in parallel with each other.

12. The antenna as set forth in claim 8, wherein said opening has an area equal to or smaller than an area of said first or second rectangular micro-strip antenna.

13. The antenna as set forth in claim 8, wherein said opening is rectangular.

14. The antenna as set forth in claim 8, wherein said opening has sides parallel to sides of said first and second micro-strip antennas.

15. The antenna as set forth in claim 8, wherein said ground plate has a width equal to or smaller than a double width of said first or second rectangular micro-strip antenna.

16. An antenna comprising:

(a) a plurality of first micro-strip antennas arranged in a line and electrically connected to one another, electric power being supplied to said first micro-strip antennas;

(b) a plurality of second micro-strip antennas each spaced away from and facing an associated one of said first micro-strip antennas, no electric power being supplied to said second micro-strip antenna;

(c) a ground plate located between said first and second micro-strip antennas, said ground plate being formed with a plurality of openings each overlapping each of said first micro-strip antennas and associated second micro-strip antennas;

(d) a first dielectric material sandwiched between said first micro-strip antennas and said ground plate; and (e) a second dielectric material sandwiched between said second micro-strop antennas and said ground plate.

17. The antenna as set forth in claim 16, wherein said first micro-strip antennas are electrically connected to one another through a micro-strip line formed on a surface of said first dielectric material.

18. The antenna as set forth in claim 16, wherein each of said openings has an area equal to or smaller than an area of each of said first or second micro-strip antennas.

19. The antenna as set forth in claim 16, wherein each of said openings is rectangular.

20. The antenna as set forth in claim 16, wherein said first and second micro-strip antennas are rectangular.

21. The antenna as set forth in claim 20, wherein each of said openings is rectangular, and has sides parallel to sides of each of said first and second micro-strip antennas.

22. The antenna as set forth in claim 16, wherein said ground plate has a width equal to or smaller than a double width of said first or second micro-strip antennas.

23. An antenna comprising:

(a) a plurality of first rectangular micro-strip antennas arranged in a line and electrically connected to one another each of said first rectangular micro-strip antennas being formed with first cut-outs at corners located on a first diagonal line thereof, electric power being supplied to said first rectangular micro-strip antennas;

(b) a plurality of second rectangular micro-strip antennas each spaced away from and facing an associated one of said first rectangular micro-strip antennas, each of said second rectangular micro-strip antennas being formed with second cut-outs at corners located on a second diagonal line perpendicular to said first diagonal line, no electric power being supplied to said second rectangular micro-strip antennas;

(c) a ground plate located between said first and second rectangular micro-strip antennas, said ground plate being formed with a plurality of openings each overlapping each of said first rectangular micro-strip antennas and an associated second rectangular micro-strip antenna;

(d) a first dielectric material sandwiched between said first rectangular micro-strip antennas and said ground plate; and (e) a second dielectric material sandwiched between said second rectangular micro-strip antenna and said ground plate.

24. The antenna as set forth in claim 23, wherein said first rectangular micro-strip antennas are electrically connected to one another through a micro-strip line formed on said first dielectric material.

25. The antenna as set forth in claim 24, wherein said first and second cutouts make an angle of about 45 degrees relative to said micro-strip line.

26. The antenna as set forth in claim 23, wherein said first and second cutouts are in parallel with each other.

27. The antenna as set forth in claim 23, wherein each of said openings has an area equal to or smaller than an area of each of said first or second rectangular micro-strip antennas.

28. The antenna as set forth in claim 23, wherein each of said openings is rectangular.

29. The antenna as set forth in claim 23, wherein each of said openings has sides parallel to sides of each of said first and second micro-strip antennas.

30. The antenna as set forth in claim 23, wherein said ground plate has a width equal to or smaller than a double width of each of said first or second rectangular micro-strip antennas.

* * * * *